US009591933B2

(12) United States Patent
Burke

(10) Patent No.: US 9,591,933 B2
(45) Date of Patent: Mar. 14, 2017

(54) DISPLAY TRAY

(75) Inventor: Raymond J. Burke, Chicago, IL (US)

(73) Assignee: WM. WRIGLEY JR. COMPANY, Chicago, IL (US)

( * ) Notice: Subject to any disclaimer, the term of this patent is extended or adjusted under 35 U.S.C. 154(b) by 770 days.

(21) Appl. No.: 13/514,000

(22) PCT Filed: Dec. 10, 2010

(86) PCT No.: PCT/US2010/059821

§ 371 (c)(1),
(2), (4) Date: Jun. 5, 2012

(87) PCT Pub. No.: WO2011/072195

PCT Pub. Date: Jun. 16, 2011

(65) Prior Publication Data

US 2012/0325762 A1 Dec. 27, 2012

Related U.S. Application Data

(60) Provisional application No. 61/285,790, filed on Dec. 11, 2009.

(51) Int. Cl.

| | |
|---|---|
| ***A47F 5/11*** | (2006.01) |
| ***A47F 3/14*** | (2006.01) |
| ***A47F 7/28*** | (2006.01) |
| ***B65D 5/72*** | (2006.01) |
| ***B65D 71/12*** | (2006.01) |
| *A47F 5/00* | (2006.01) |

(52) U.S. Cl.

CPC ..... *A47F 5/112* (2013.01); *A47F 3/14* (2013.01); *A47F 7/28* (2013.01); *B65D 5/724* (2013.01); *B65D 71/125* (2013.01); *A47F 5/0025* (2013.01); *B65D 2571/0066* (2013.01); *B65D 2571/00141* (2013.01); *B65D 2571/00296* (2013.01); *B65D 2571/00302* (2013.01); *B65D 2571/00796* (2013.01)

(58) Field of Classification Search

CPC ..... B65D 5/4275; B65D 5/54; B65D 5/5206; B65D 5/725; B65D 71/36; B65D 2571/00141; B65D 5/724; B65D 71/125; B65D 2571/00296; B65D 2571/00302; B65D 2571/0066; B65D 2571/00796; A47F 1/08; A47F 1/087; A47F 5/112; A47F 5/0025; A47F 3/14; A47F 7/28

USPC ..... 211/71.01, 74, 59.2, 59.3, 85.18

IPC ..... B65D 5/724,71/125, 2571/00141, 2571/00296, 2571/00302, 2571/0066, 2571/00796

See application file for complete search history.

(56) References Cited

U.S. PATENT DOCUMENTS 1,578,819 A * 3/1926 Freeland ..... A47F 5/0025 206/561
1,753,957 A * 4/1930 Washburn ..... 221/311
(Continued)

FOREIGN PATENT DOCUMENTS

CN 3322003 S 9/2003
CN 1012496858 A 8/2008
(Continued)

*Primary Examiner* — Korie H Chan

(57) ABSTRACT

A display tray stores and dispenses a plurality of articles. The display tray includes an upper region and a lower region. The upper region of the display tray contains a greater number of articles than the lower region. The display tray may be used upon an angled shelf to optimize the number of articles presented.

8 Claims, 12 Drawing Sheets

(56) References Cited

U.S. PATENT DOCUMENTS

| | | | | | |
|---|---|---|---|---|---|
| 2,294,965 | A * | 9/1942 | Davidson | B65D 5/5425 | 206/45.21 |
| 2,512,233 | A * | 6/1950 | Hudock | A47F 3/14 | 206/557 |
| 2,644,633 | A * | 7/1953 | Stopper | B65D 5/2038 | 229/110 |
| 2,708,085 | A * | 5/1955 | Bonaccorsi | 248/450 | |
| 2,852,327 | A * | 9/1958 | Mason | A47F 1/087 | 211/59.2 |
| 3,463,379 | A * | 8/1969 | Dlugopolski | B65D 5/2047 | 229/110 |
| 4,308,974 | A * | 1/1982 | Jones | 221/196 | |
| 4,658,984 | A * | 4/1987 | Brunner | 221/64 | |
| 5,228,590 | A * | 7/1993 | Blasko et al. | 220/501 | |
| 5,247,798 | A * | 9/1993 | Collard, Jr. | 62/3.62 | |
| 5,284,257 | A | 2/1994 | Schum | | |
| 5,289,943 | A * | 3/1994 | Powell | 221/67 | |
| 5,396,997 | A | 3/1995 | Johnson | | |
| 5,597,114 | A * | 1/1997 | Kramedjian et al. | 229/122.1 | |
| 5,680,744 | A | 10/1997 | Kramedjian et al. | | |
| 5,788,117 | A * | 8/1998 | Zimmanck | 221/285 | |
| 6,253,930 | B1 * | 7/2001 | Freidus et al. | 211/59.2 | |
| 6,637,604 | B1 | 10/2003 | Jay | | |
| 7,614,543 | B1 * | 11/2009 | Miller | 229/122.1 | |
| 2004/0007546 | A1 | 1/2004 | Stinnett et al. | | |
| 2005/0139501 | A1 | 6/2005 | Lingamfelter | | |
| 2006/0157546 | A1 | 7/2006 | Holley, Jr. | | |
| 2007/0089922 | A1 | 4/2007 | Iwasaki | | |
| 2007/0107457 | A1 | 5/2007 | Morris | | |
| 2007/0210144 | A1 * | 9/2007 | Brand | B65D 71/36 | 229/122.1 |
| 2009/0095799 | A1 * | 4/2009 | Garner | B65D 71/36 | 229/110 |

FOREIGN PATENT DOCUMENTS

| | | | |
|---|---|---|---|
| WO | WO2004030497 | A1 | 4/2004 |
| WO | 2004/090444 | A1 | 10/2004 |

* cited by examiner 30
36
14
F''
68
F'
A'
F''
66
A''
A''
A''

DISPLAY TRAY

CROSS-REFERENCE TO RELATED APPLICATIONS

This application is a U.S. National Phase Patent Application of International Application Ser. No. PCT/US10/59821, filed Dec. 10, 2010, which is incorporated herein in its entirety, and which claims priority benefit of U.S. Provisional Patent Application Ser. No. 61/285,790, filed Dec. 11, 2009, the entire contents of which also are incorporated herein by reference.

FIELD OF THE INVENTION

The present invention relates to packaging. More particularly, the present invention relates to a tray for storing, displaying and dispensing articles and, in particular, cylindrical articles and bottles.

BACKGROUND OF THE INVENTION

Some retailers have expressed a desire for a display tray, which contains a large number of articles but which is compact and from which articles are removed easily.

Articles, such as cylindrical articles and bottles, have been packaged in numerous ways in order to present individual articles to a consumer in a form which is appealing. Such trays have included articles vertically oriented in a tray, and articles positioned horizontally in a carton or box. The latter tray is advantageous in that articles may be displayed to a consumer and when a consumer removes one, another article may be automatically fed for easy display and reach by the consumer. However, it has been identified that rectangular boxes must be inclined in order for automatic feed and delivery to the consumer using gravity.

Some retailers have angled store shelves to present articles to consumers such that articles are easily accessible and visible to the consumer. It has been found that rectangular boxes are inefficient in that both the top and bottom lengths must be sized to fit within the bottom length of the angled shelf, thus not optimizing the space available on the store shelf.

There is a need for a compact tray for holding articles in relatively large quantities, such that the articles may be easily removed from the tray. In particular, a need exists for effective, convenient and attractive display trays for articles, and in particular cylindrical articles and bottles.

SUMMARY OF THE INVENTION

The invention relates to packaging. In particular, the invention relates to a display tray for storing, displaying and dispensing a plurality of articles. In accordance with one embodiment of the invention, the display tray may include a front wall, a rear wall, a bottom wall and a plurality of side walls defining a receptacle for holding articles. The top of the display tray may be configured to be open thereby providing access to the receptacle.

In accordance with one embodiment, the display tray may further define a lower region and an upper region. Each region of the display tray is for holding a number of articles, typically cylindrical articles or bottles. The articles, such as bottles, may generally be oriented in a horizontal direction. The upper region has a length greater than the lower region. Accordingly, the upper region may be capable of containing a greater number of articles than the lower region.

The display tray may be arranged upon an angled shelf. Upon positioning the bottom of the tray upon the angled shelf, the top of the display tray extends toward the back wall of the shelf. In some cases, where the shelf includes a shorter back wall, the top of the display tray may extend over the back wall of the shelf.

The lower region of the display tray is capable of containing a lesser number of articles than the upper region by the rear wall being outwardly angled from the front wall. When articles are placed within such a display tray, the articles may engage an angled portion of the rear wall which may direct a forward force to the articles causing the articles to move toward the front of the tray. The front wall typically includes an opening to access the articles. Article retaining panels may be included upon or integrally formed as part of the front wall to prevent the articles from falling out of the tray due to the forward force caused by engagement of the articles with the rear wall or from gravity.

The invention further provides that in an embodiment, the lower region of the display tray may also be adapted to contain a lesser number of articles than the upper region through use of a raised panel. The raised panel may be adjacent the bottom and rear walls. The raised panel may include a top face to support an article in the upper region and a side face to contain or prevent movement of an article in the lower region.

In accordance with an alternate embodiment, the raised panel may further be a false bottom. The false bottom may be formed from a portion of the rear and bottom walls and foldably joined to them. When installed on a shelf, the false bottom may be folded inward to form an angled portion of the rear wall. The false bottom may be moveable from a corner position in alignment with the rear and bottom walls to an inner position. The inner position may be between the sidewalls. The false bottom may form a top arch that supports an article in the upper region and a lower arch that contains or prevents movement of an article in the lower region.

BRIEF DESCRIPTION OF THE DRAWINGS

The present invention will now be described by way of example, with reference to the accompanying drawings.

DESCRIPTION OF THE INVENTION

Figure 1:
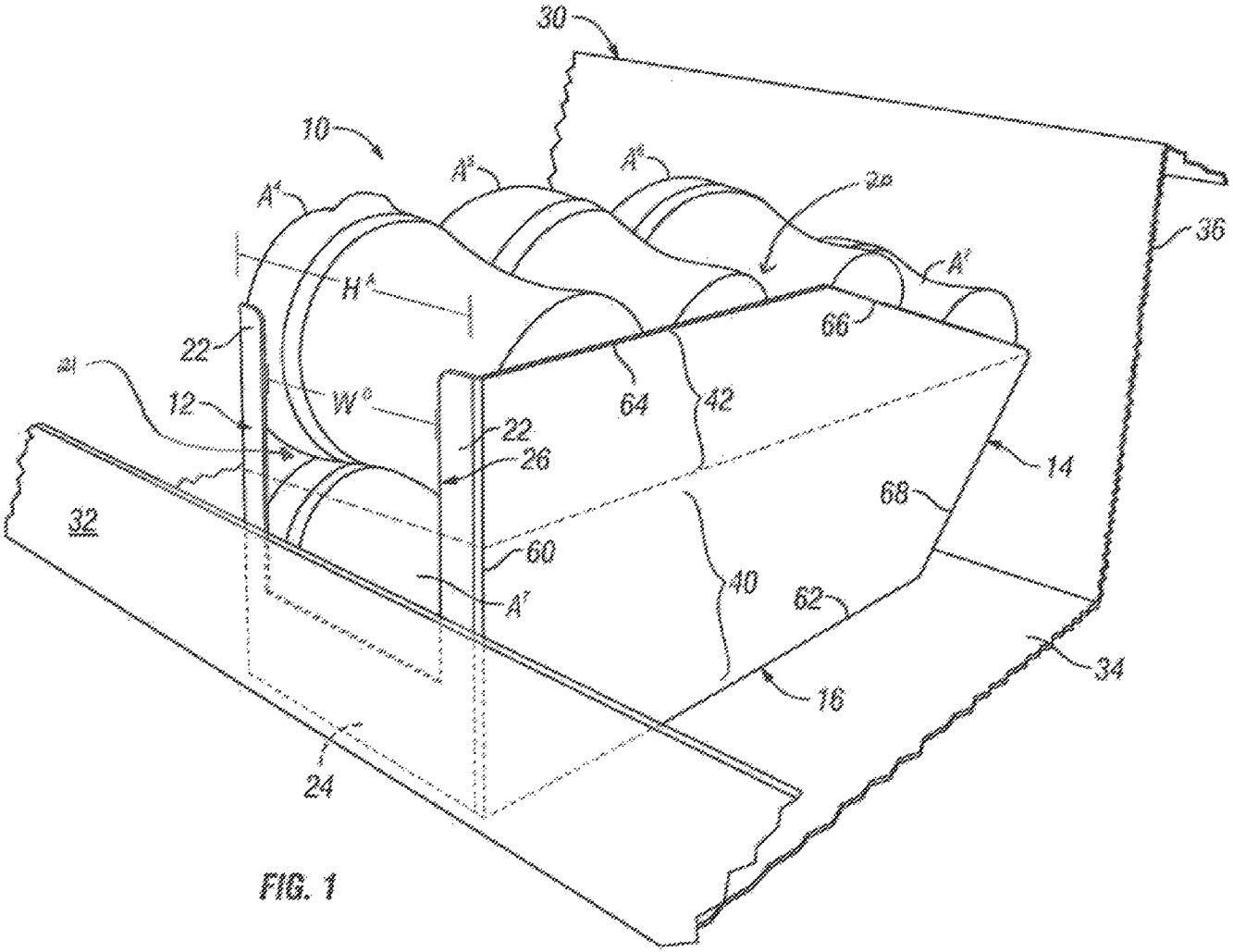
FIG. 1 is a perspective view of a tray on an angled shelf in accordance with an embodiment of the invention.

A display tray for containing and dispensing a plurality of objects is herein described. As illustrated in the accompanying figures, the display tray is configured to provide a receptacle to store, display and dispense articles in an efficient and user friendly manner and optimizing the number of articles displayed. The display tray of the present invention is configured to enhance the removal of articles from the tray and facilitate the displaying of articles on an angled shelf. The display tray is particularly useful for articles which have a tendency to move relative to one another by rolling in response to the positioning and/or configuration of the display tray, such as rolling toward the front of the display tray. Moreover, the display tray may be useful for articles that are sized relative to the dimensions of the display tray, such that the articles are larger in size (e.g., the height of the articles is approximately the width of the display tray). The display tray enables the optimization of space for providing articles on an angled shelf, such that the tray allows for additional storage of an article. In one embodiment, the tray 10 may be made of paperboard. Alternatively, the tray 10 may be made of cardboard or an alternate paper based product, either single or multi-layered.

The articles, as described, may include but are not limited to, cylindrical-like containers that may be used for a variety of products, including comestibles, such as chewing gum and other confections. In one embodiment, the chewing gum may be in various product configuration/forms including, but not limited to, pellets, tabs, balls or sphere-shaped pieces, irregular shaped or any other shape or form that may readily be provided in a cylindrical-like container.

The display tray of the present invention may be further configured to receive and dispense a plurality of articles arranged within the receptacle of the tray. As illustrated in the Figures, the articles may be provided in layers or regions of stacked articles. The number of layers (i.e., rows) of articles or regions of stacked articles may be greater than those illustrated. For example, in one embodiment, as illustrated in the provided Figures, four (4) articles may be stacked over three (3) articles to provide a total of 7 articles within the display tray. This configuration maximizes the number of articles that may be provided within the display tray configured for an angled shelf. Other combinations include but are not limited to, five (5) articles stacked over four (4), seven (7) articles stacked over six (6) articles, or any other relative combinations (i.e., "x" articles stacked over "x−1"articles). Additionally, the number of layers (or rows) of articles within the display tray may be greater than two (2) layers, including but not limited to three (3) or four (4) layers (rows) of articles within the display tray. For example, in one embodiment wherein the display tray includes three (3) layers, the articles may be arranged such that six (6) articles may be stacked over five (5) articles, which are then stacked over four (4) articles. In another embodiment, five (5) articles may be stacked over four (4) articles which may be stacked over three (3) articles. (i.e, "x" articles stacked over "x−1"articles, stacked over "x−2" articles). In one embodiment, the smaller the diameter of the article the greater the number of articles may be placed horizontally into a row.

With reference to the provided Figures, in particular FIG. 1, an embodiment of the display tray 10 of the present invention is shown. The display tray 10 comprises a front wall 12, a rear wall 14, a bottom wall 16, side walls 18, and an open top 20 defining a receptacle 21 for receiving articles (A). The front wall 12 includes side article retaining panels 22 and a lower article retaining panel 24 therein forming opening 26.

Figure 2:
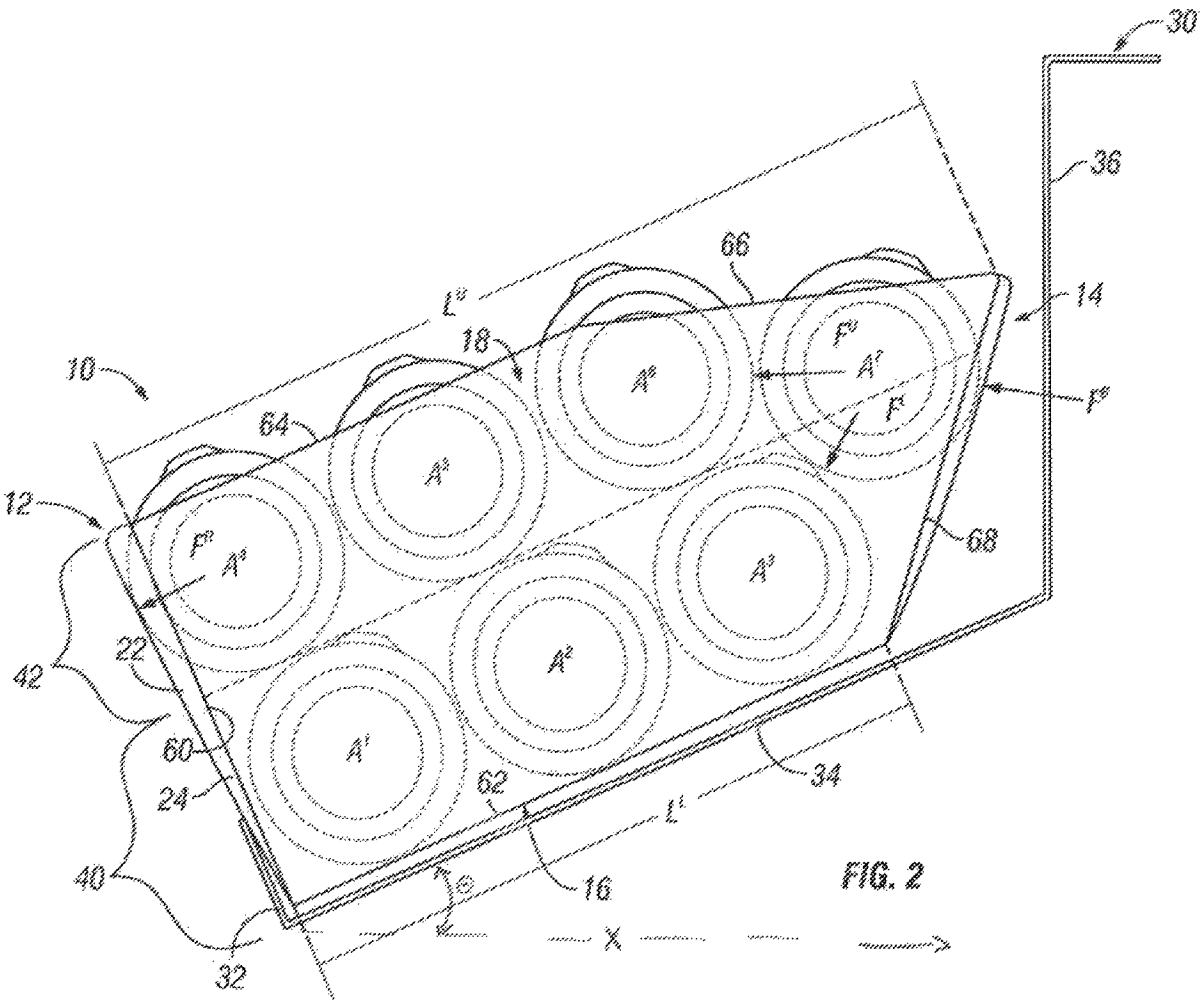
FIG. 2 is a side view of the tray on the angled shelf as shown in FIG. 1.

As further shown, for example in FIG. 2, the display tray 10 is positioned upon an angled shelf 30 having a front lip 32, an angled shelf bottom 34, and a shelf back 36. The front lip 32 of the angled shelf 30 holds the display tray 10 and prevents the display tray 10 from moving off the angled shelf 30. The angled shelf bottom 34 may be positioned at a variety of angles (Θ). In particular, the angled shelf may be oriented in an upward angle from the front lip 32 to the shelf back 36. The upward angle may be provided in varying degrees (Θ) relative to the X axis depending on the type of display. In one embodiment, the shelf bottom 34 may be angled up to a 5% incline, between a 5-10% incline, between a 10-20% incline, between a 20-30% or at inclines of greater than 30%. As illustrated in the figures, the shelf bottom 34 has an approximately 23.5% incline.

Similar to the angle of the shelf, the length of the angled shelf bottom 34 may vary depending upon the location and purpose of the shelf. In general, shelves being displayed at the front end of a retail store are shorter than shelves displayed in the back end of the store. Accordingly, the dimensions of the shelf as illustrated are representative in nature and may be varied depending on the location of the shelf and design of the display unit. As shown throughout the Figures, the angled shelf 30 is representative of an angled shelf at the front end of a retail store. As a result, the angled shelf has a relatively short shelf bottom 32. The angled shelf bottom 32 may be less than four (4) inches long, between four (4) to eight (8) inches long, between eight (8) to ten (10) inches long, or at lengths greater than ten (10) inches long.

Moreover, the shelf back 36 may be at various heights depending upon products typically displayed upon the angled shelf 30 and whether the angled shelf 30 is located upon a lower, middle, upper, or top portion of a display rack (not shown). Accordingly, the shelf back 36 may be less than two (2) inches long, two (2) to four (4) inches long, four (4) to eight (8) inches but sometimes may be greater than eight (8) inches long.

The display tray may be designed such that at least a portion of the bottom wall 16 rests flush or parallel the shelf bottom 34. Alternatively, the display tray may be further designed so that the rear wall 14 of the display tray 10 does not interact with the shelf back 36, as a result at least a portion of the bottom wall 16 may not rest flush or parallel to the shelf bottom 34. In the event a shelf back 36 may be missing or the shelf back 36 is relatively short (e.g. the angled shelf 30 is located on the top portion of a display rack, for example around two (2) inches high) the display tray's rear wall 14 or a portion of the rear wall 14 may be capable of being positioned over or extending over the shelf back 36. Alternatively, in the event the shelf back 36 may be higher in height, the display tray's rear wall 14 may generally follow the angle of shelf back 36.

In accordance with an embodiment, as illustrated in FIG. 1, the display tray 10 may hold seven (7) cylindrical articles oriented in the horizontal direction. The articles as illustrated are generally cylindrical and have a slightly hour-glass shape. A generally cylindrical article has a length and a circular cross-section along at least part of the length to permit the article to roll along a surface. Being oriented in the horizontal direction means positioning the cylindrical object or generally cylindrical object on its side.

In an embodiment, the articles (A) have a height $H^A$ which is larger than width $W^O$ of opening 26 defined by front wall 12 and retaining panels 22, 24. As previously suggested, the front 12, rear 14, bottom 16, and side walls 18 define a receptacle 21 having a lower region 40 and an upper region 42. Each region is capable of containing a number of articles A oriented in the horizontal direction. The upper region 42 has a length $L^U$ which is greater than a length $L^L$ of the lower region 40. The lower region 40 is capable of containing a lesser number of articles than the upper region 42. The space realized by absent lower article facilitates positioning of the display tray 10 upon an angled store shelf.

As seen in FIGS. 1-5, the lower region 40 is capable of containing a lesser number of articles than the upper region 42 by the rear wall 14 of the tray 10 elevating the rear most article $A^7$ into the upper region 42. The rear most article $A^7$ may be elevated by the rear wall 14 being outwardly angled in relation to the front wall 12. As illustrated, the rear most article $A^7$ from opening 26 may be slightly lower than the other articles in the upper region 42. Although slightly lower, this article is considered to be in the upper region and continues to be so as long as it is only slightly higher than the articles in the lower region 40 and does not rest on the bottom wall 16 of the display tray 10. Alternatively, as seen in FIGS. 6-14, a panel may be placed adjacent to the bottom wall 16 and rear wall 14 of the tray 10 to further elevate the rear most article $A^7$ to a position that is further aligned with the other articles of the upper region 42. In accordance with an embodiment of the invention, the display tray 10 sits adjacent the shelf bottom 34 and the rear most point of the tray 10 may not interfere with the back wall 36 of the shelf 30.

Figure 3:
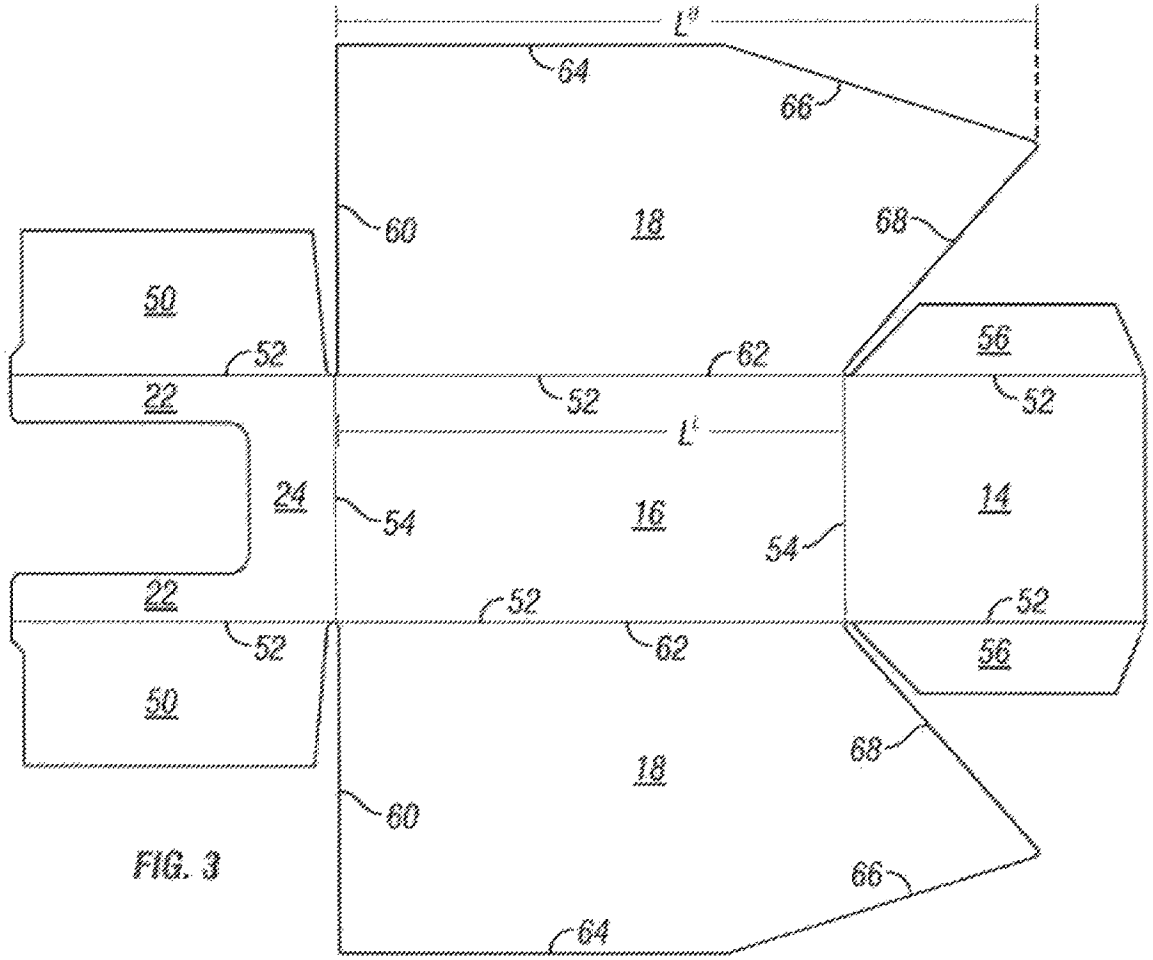
FIG. 3 is a top view of a tray blank of the tray as shown in FIG. 1.

As seen in FIGS. 1-3, an embodiment of a display tray is provided. It includes front wall 12, rear wall 14, bottom wall 16, and side walls 18 defining a receptacle 21. The front wall 12 includes side article retaining panels 22 and lower article retaining panel 24 to form opening 26. The rear wall 14 is outwardly angled in relation to the front wall and directs articles A toward the front wall 12. "Directs articles" means positioning or angling articles such that if at least one article A is removed from the display tray at least one article A will move toward the front opening 26 to an extent greater than that provided by gravity alone. The rear wall 14 may further include an angled portion. In one embodiment, an angled portion of the rear wall 14 may have an angle from the bottom wall 16 corresponding to the angle between the shelf bottom 34 and shelf back.

In one embodiment, a lower row of articles $A^1$, $A^2$, $A^3$ may be positioned in the lower region 40 and an upper row of articles $A^4$, $A^5$, $A^6$ and $A^7$ may be positioned in the upper region 42. As previously described, the article $A^7$ may be positioned in the upper region 42 and is positioned adjacent the rear wall 14. Accordingly, the article $A^7$ positioned adjacent the rear wall 14 engages the rear wall 14 and may cause the rear wall 14 to slightly bow outward. The article $A^7$ therefore rests against $A^6$ in the upper region and $A^3$ in the lower region 40. As a result, rear wall 14 may direct a force $F^B$ to article $A^7$ which translates an upper force $F^U$ towards article $A^6$ and lower force $F^L$ toward article $A^3$. The upper force $F^U$ may cause a force $F^R$ directed from article $A^6$ toward the retaining wall 22. Each of the forces $F^B$, $F^U$, $F^L$, $F^R$ may combine in a way to direct articles A toward the front wall 12 upon the removal of articles from the display tray 10.

Accordingly, for example, upon removing article $A^4$ from the tray, article $A^5$ may shift into a space provided between article $A^1$ and $A^2$ and article $A^6$ may shift between article $A^2$ and $A^3$. Next, article $A^5$ may be removed without causing any other article shifting. In the event article $A^1$ is removed, this movement may cause $A^2$ to move forward and $A^6$, $A^3$ and $A^7$ to be redistributed. Next, the articles will flow toward the opening 26 in order through the lower region 40.

FIG. 3 illustrates a top view of a tray blank of a first embodiment of display tray 10. The display tray 10 includes forward flaps 50 to join the front wall 12 to the side wall 18. The forward flaps 50 are bent along horizontal fold lines 52 and then along vertical fold line 54 such that the forward flaps 50 may be joined to side wall 18 when side wall 18 is bent along a horizontal fold line 52. When attached by a connecting means, such as adhesive, hook and loop fastener, or other coupler, the front wall and the side wall are in a generally perpendicular relationship.

In an embodiment, the side walls 18 have a front edge 60, a bottom edge 62, a top edge 64, a top declining edge 66, and lower angled 68. The rear wall 14 is positioned adjacent the lower angled edge 68 by moving the rear wall 14 along a vertical fold line 54 to an angled position to attach rear flaps 56 to side wall 18.

Figure 4:
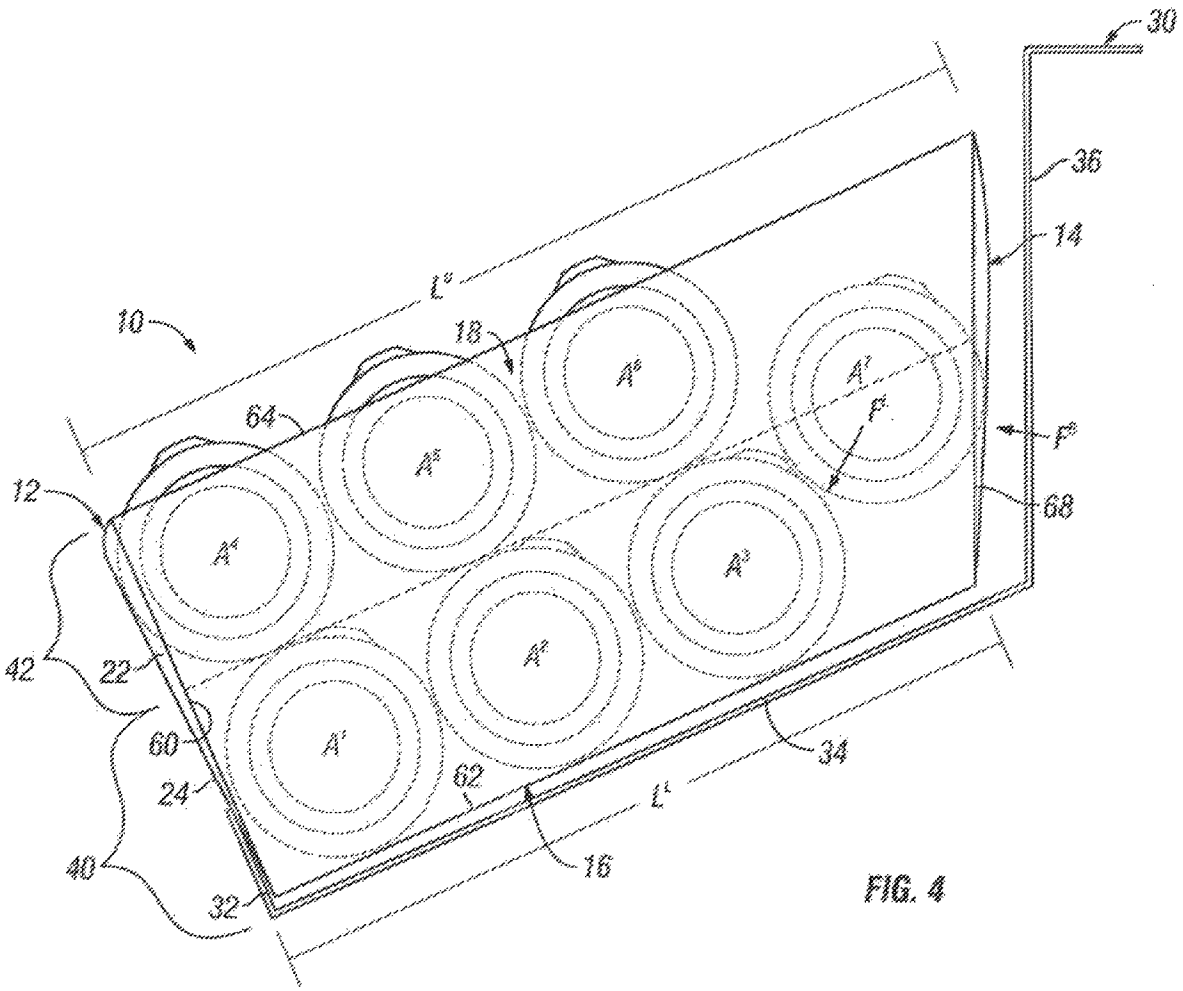
FIG. 4 is a side view of a tray in accordance with another embodiment of the invention.
Figure 5:
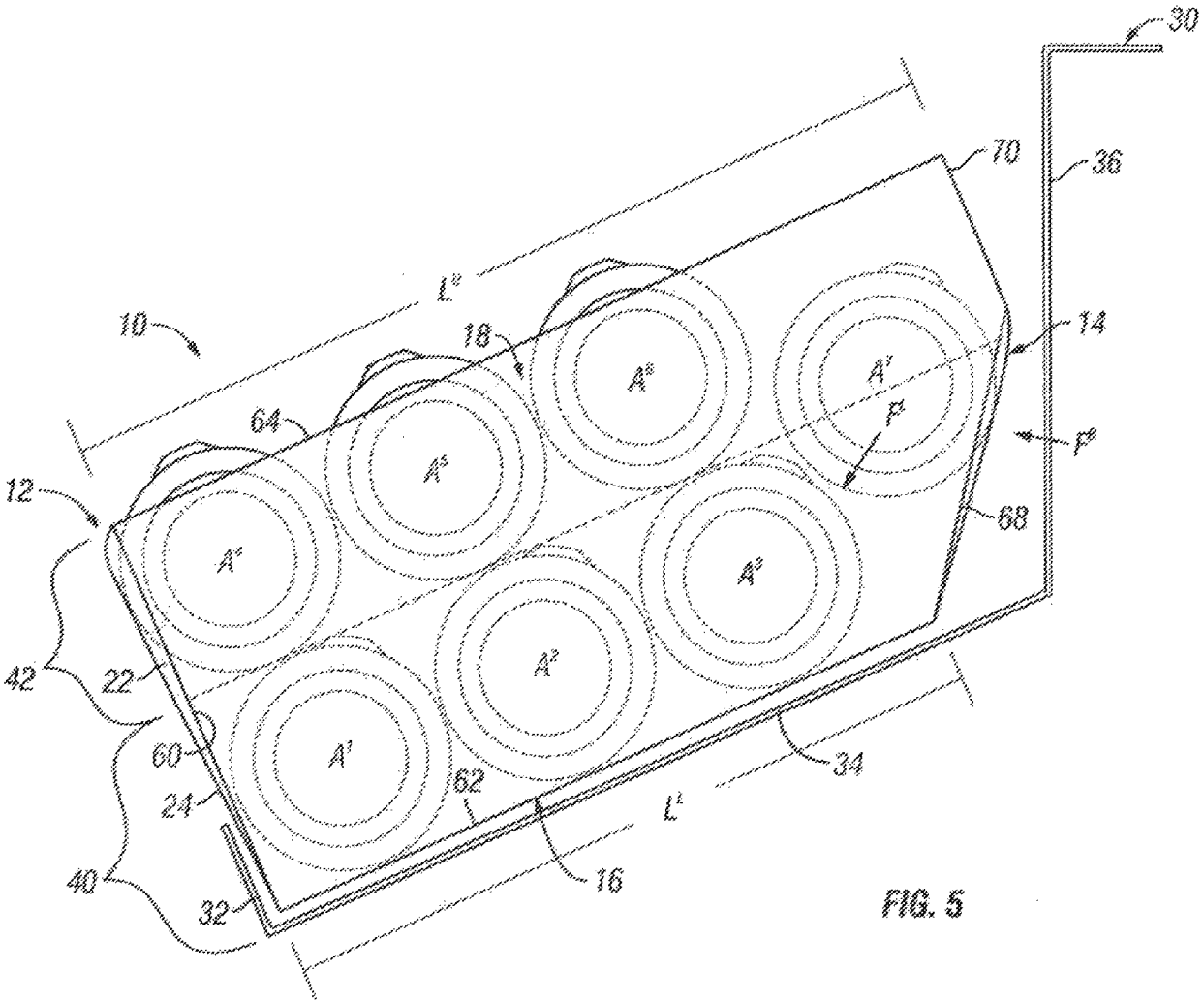
FIG. 5 is a side view of a tray in accordance with another embodiment of the invention.

In another embodiment, as seen in FIG. 4, a side view of a tray 10 is provided. This tray may function similarly to the first embodiment detailed in FIGS. 1-3; however, as illustrated article $A^7$ interacts with rear wall 14 and engages $A^3$ but not $A^6$. Therefore, a force $F^B$ from the rear wall 14 only translates a force $F^L$ to $A^3$. However, it has a straight side wall top edge 64 that extends to the rear wall 14. As such the side wall is a trapezoid. In another embodiment, as seen in FIG. 5, the tray includes a side wall 18 wherein a lower angled edge 68 and an upper edge 70 is provided.

Figure 6:
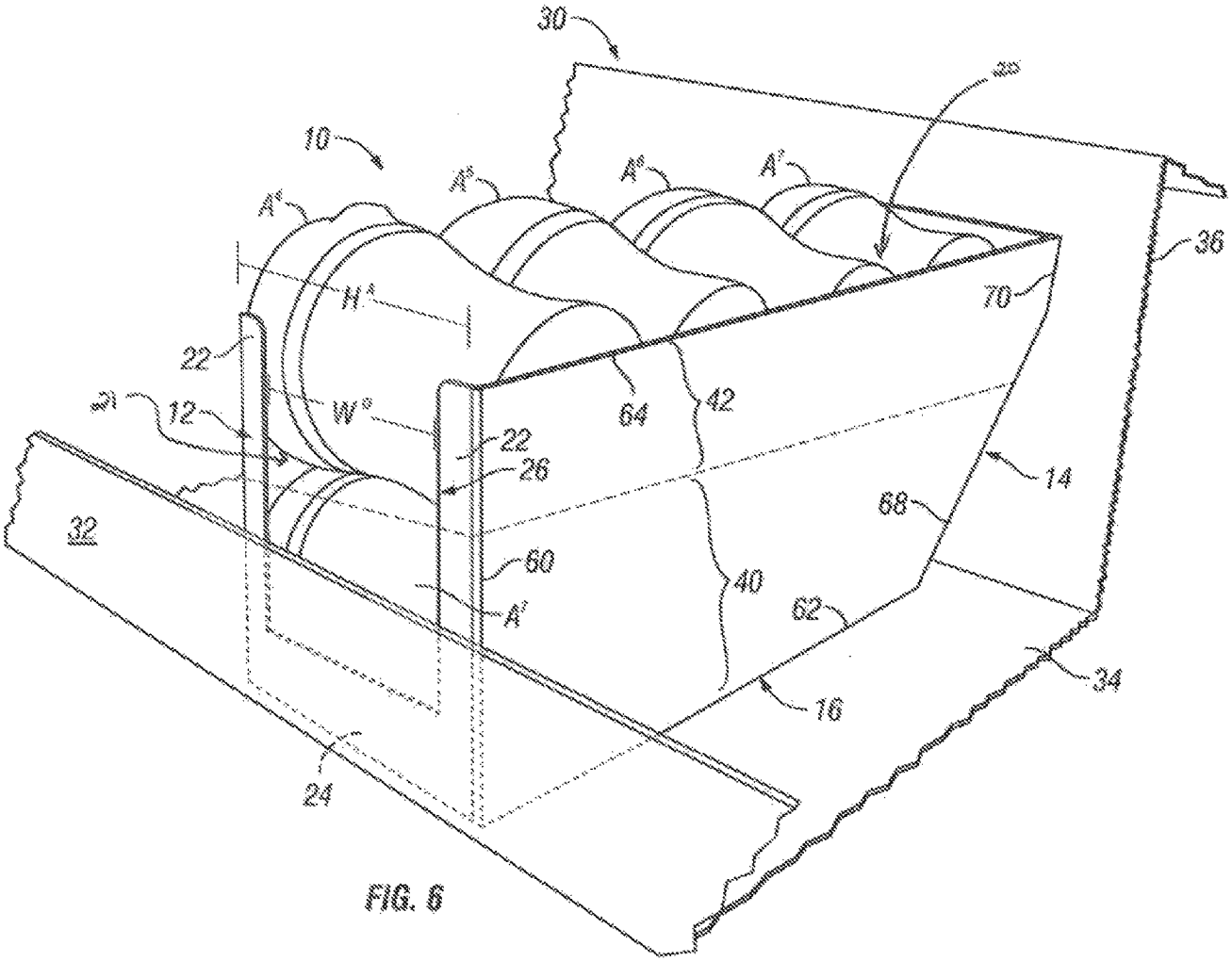
FIG. 6 is a perspective view of a tray having a raised panel on an angled shelf in accordance with an alternate embodiment of the invention.

FIG. 6 is a perspective view of another embodiment of the tray in which the use of a raised panel 82 may be included to enable a greater number of articles in the upper region 42 than the lower region 40. Due to the configuration of the angled shelf, the display tray having a raised panel allows for an additional article to be provided in the tray, thereby optimizing the capacity of the tray. The raised panel 82 is adjacent the bottom wall 16 and rear wall 14 and reduces the capacity of the lower region 40, while optimizing the capacity of the upper region 42. Accordingly, the raised panel 82 is capable of supporting at least one article in the upper region. As illustrated in FIGS. 6-13, the raised panel 82 may be a false bottom in an embodiment, or alternatively, it may be a rigid panel 80, as further illustrated in FIG. 14.

Figure 7:
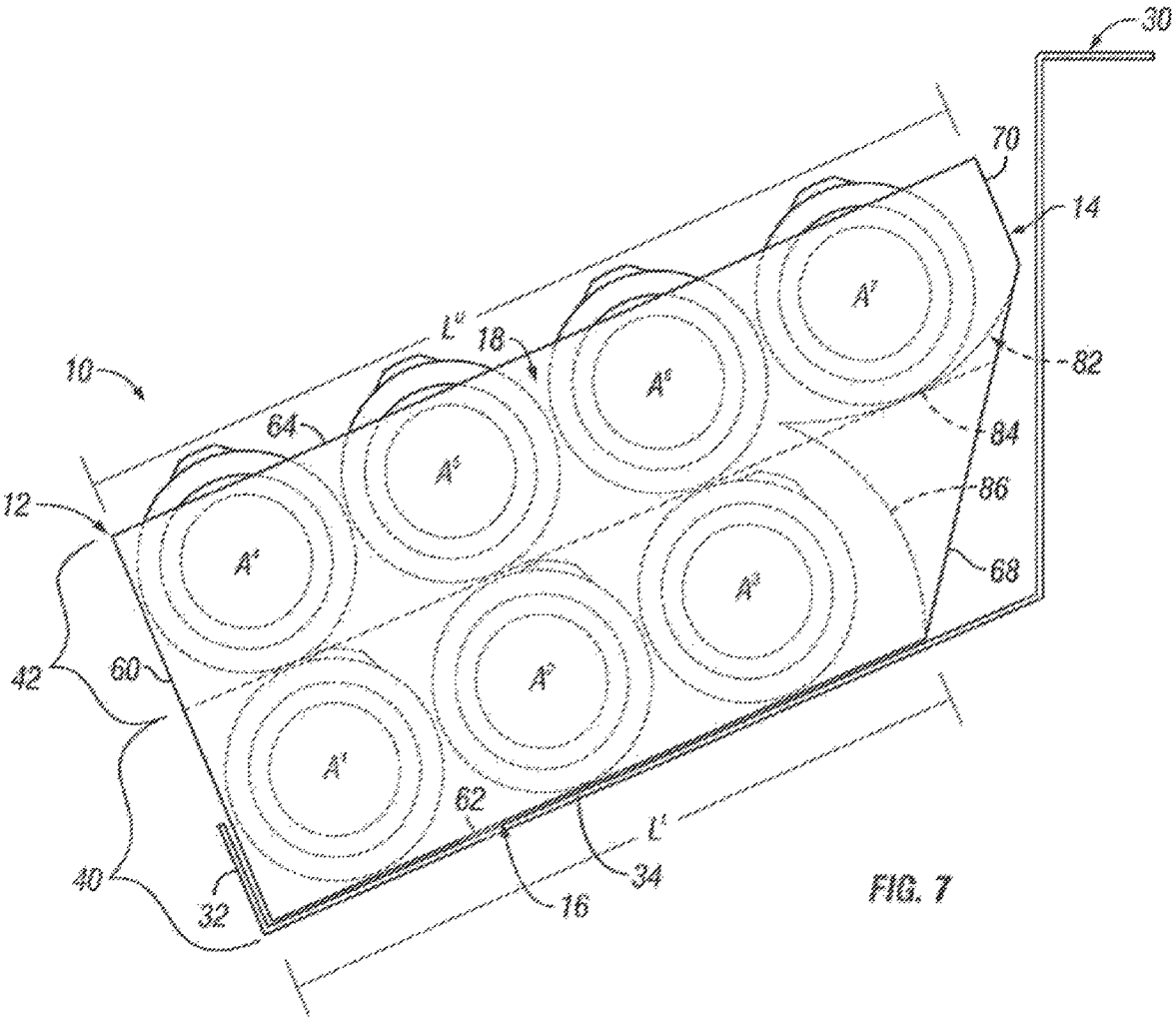
FIG. 7 is a side view of the tray as shown in FIG. 6 on an angled shelf.

More specifically, as shown in FIG. 7, article $A^7$ may be supported by the raised panel 82. The raised panel 82 operates as a false bottom, and as a result does not direct any force through article $A^7$. As a result, there is not an additional force originating from panel 82 towards article $A^4$ other than that cause by the incline of angled shelf 30. Therefore, the retaining wall 22 may be further provided to prevent inadvertent movement of the articles from the front opening 26 but may not be necessary to retain articles from the any additional forces caused by interaction of article $A^7$ against the rear wall 14 of the display tray 10.

Figure 8:
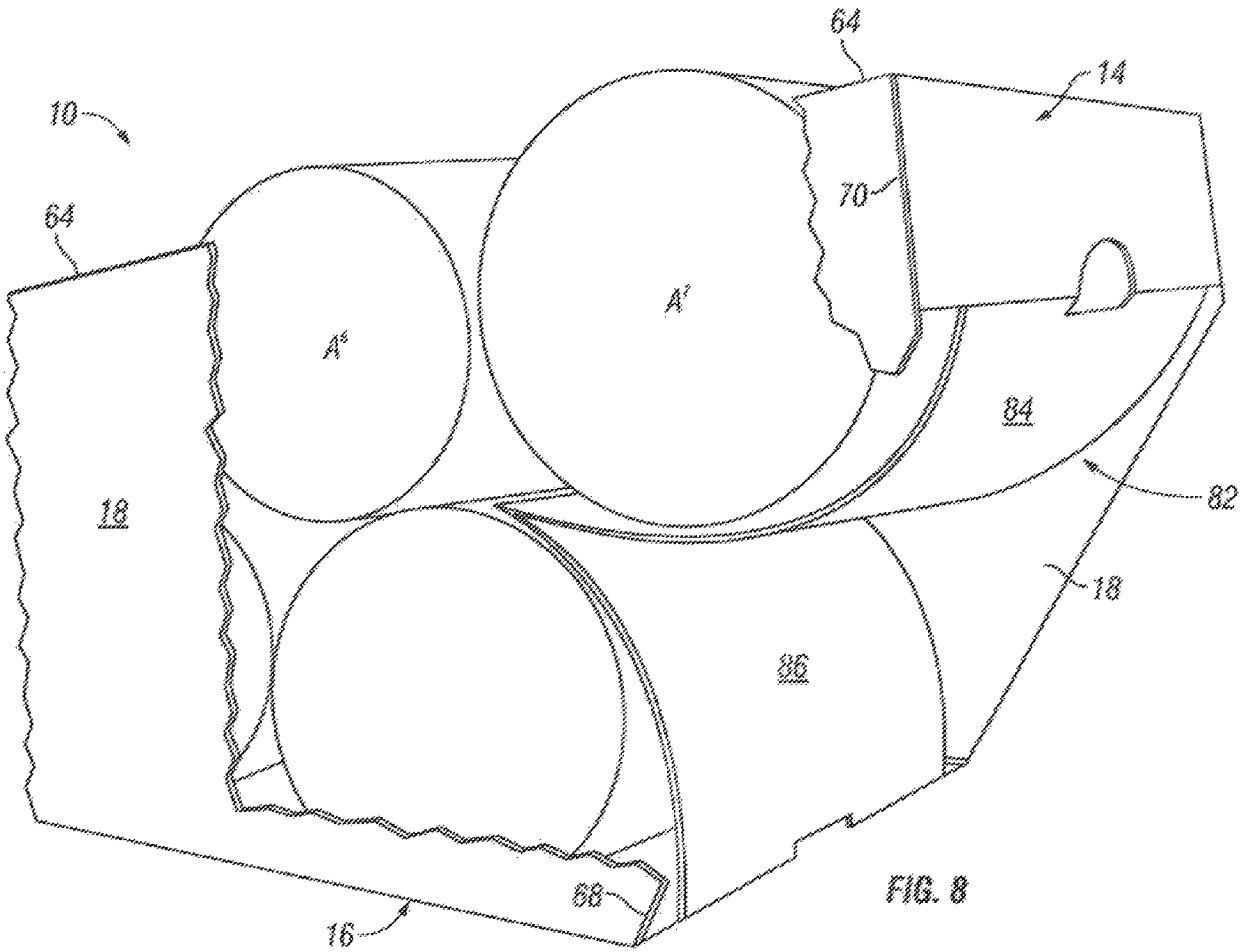
FIG. 8 is a rear perspective view of the tray as shown in FIG. 6 with a portion of a side wall cut-away.

In accordance with the one embodiment, the raised panel is further illustrated in FIG. 7-8. The raised panel 82 (i.e., false bottom) may further include a top section 84 which in the inner position forms a top arch which cups the article $A^7$ in the upper region 42 and a lower section 86 which in the inner position forms a lower arch which contains an article in the lower region 40.

Figure 9:
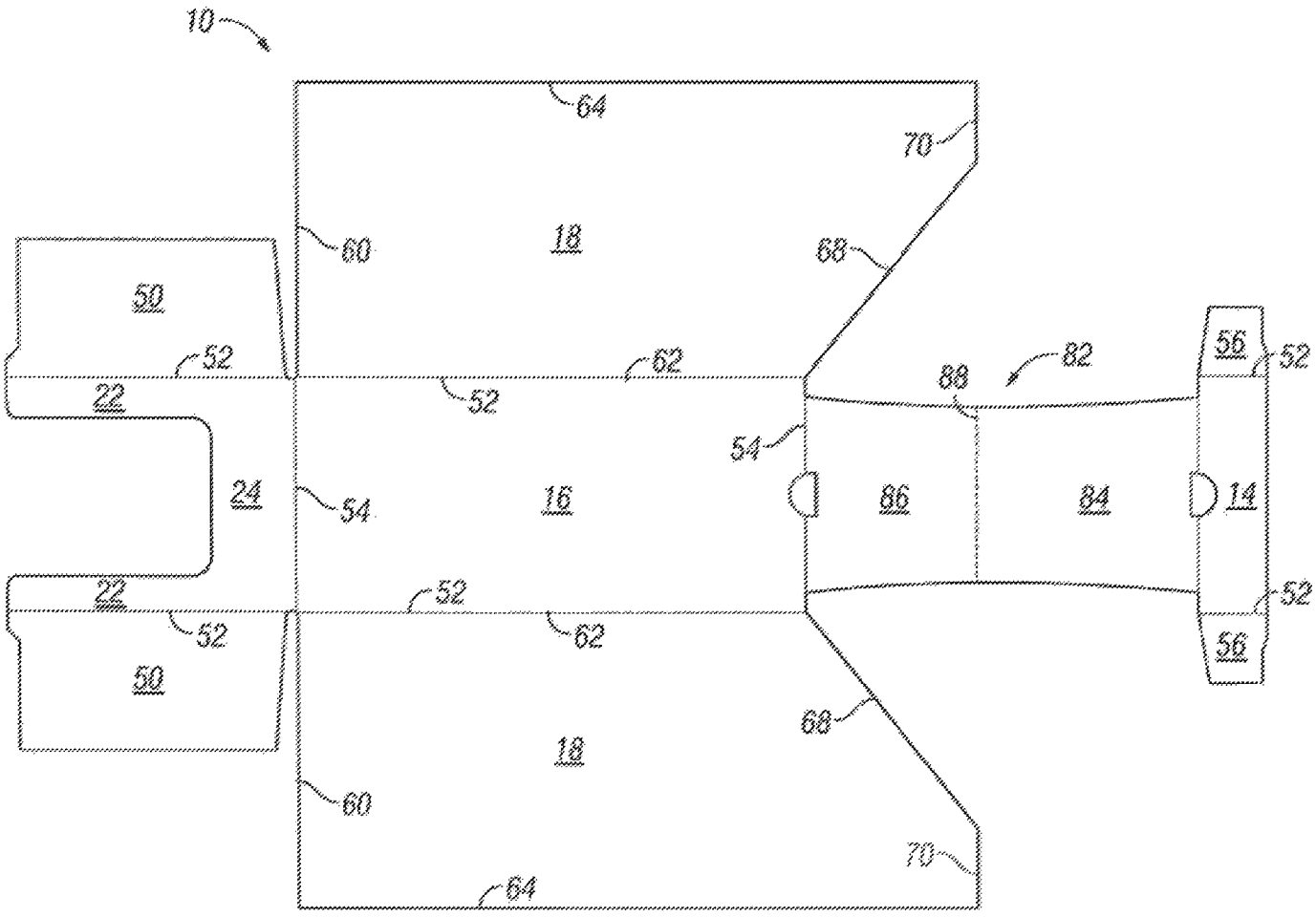
FIG. 9 is a top view of a tray blank of the tray as shown in FIG. 6.

FIG. 9 is a tray blank of an embodiment of tray 10. A perforated vertical fold line 88 is between the top section 84 and the lower section 86, thereby allowing the creation of raised panel 82. As shown, in one embodiment, the raised panel 82 may be integrally formed as part of the tray or alternatively, it may be an additional component that is separate from the tray and may be inserted at a later date.

Figure 10:
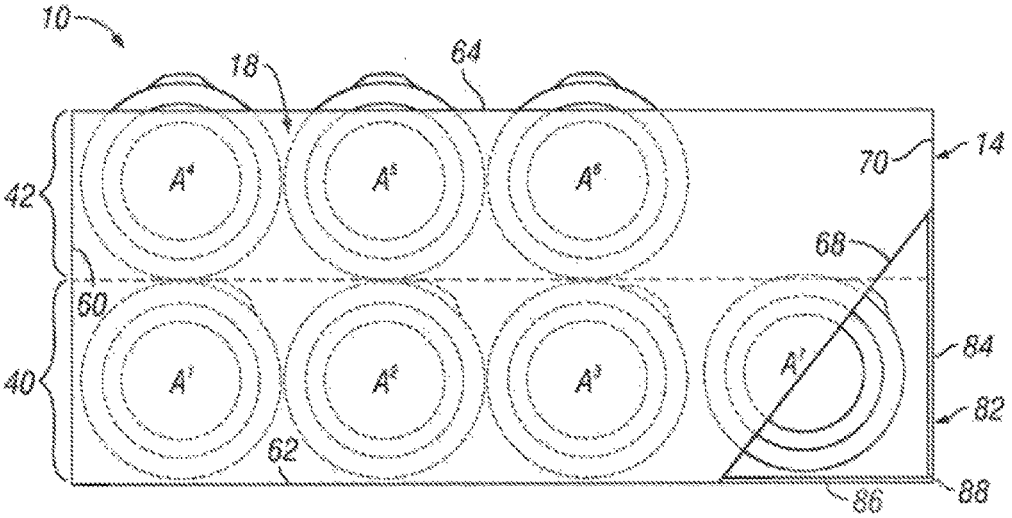
FIG. 10 is a side view of another configuration of the tray as shown in FIG. 6.
Figure 11:
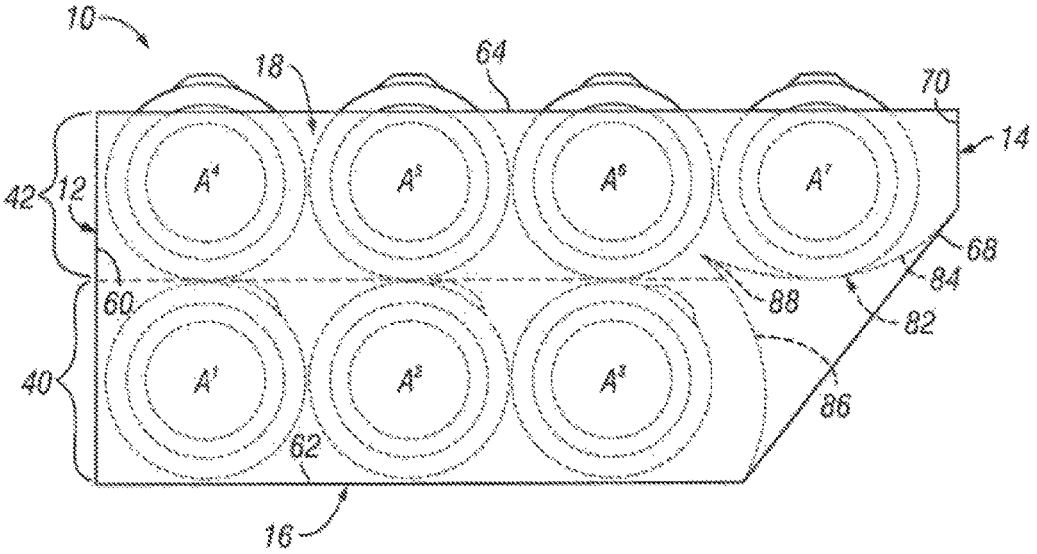
FIG. 11 is a side view of another configuration of the tray as shown in FIG. 6.

FIG. 10 is a side view of the tray 10 with the panel 82 in a lower position and article $A^7$ in the lower region 40. As seen in FIG. 11, during manufacture the tray is formed and filled with articles $A^1$-$A^7$ and then the panel 82 may be moved relative to side walls 18 moving $A^7$ into the upper region 42. Alternatively, the panel 82 may be placed into an upper position prior to filling and then filled with articles $A^1$-$A^7$. Still alternatively, the tray may be formed and filled with articles $^1$ $A^3$, the panel 82 inserted between side walls 18, and then filled with articles $A^4$ -$A^7$. The flexibility of the movement of panel 82 and integrated perforation between sections 84 and 86 allow for further optimization of the tray to display an increased number of articles.

Figure 12:
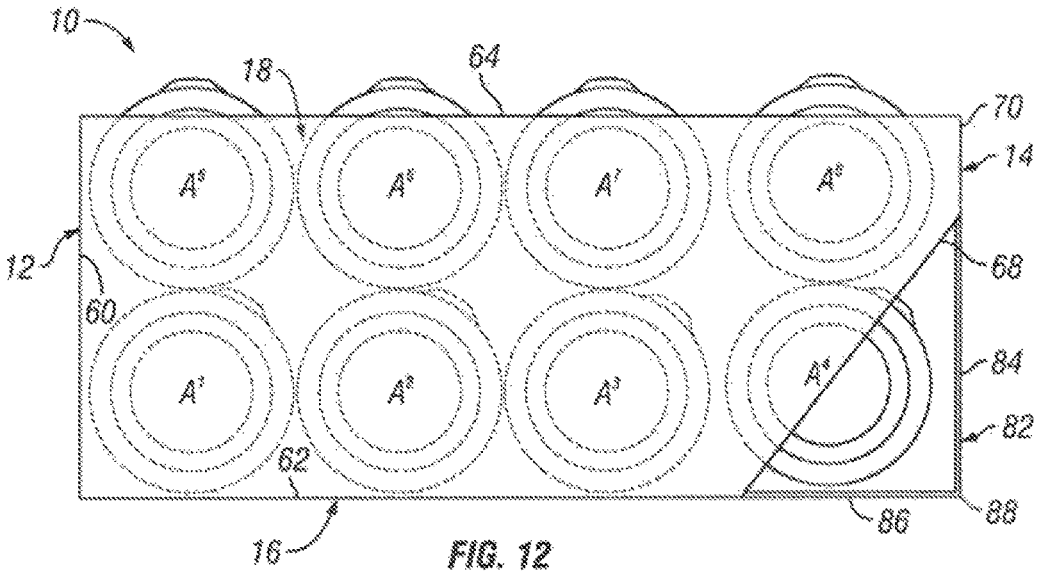
FIG. 12 is a side view of another configuration of the tray as shown in FIG. 6.
Figure 13:
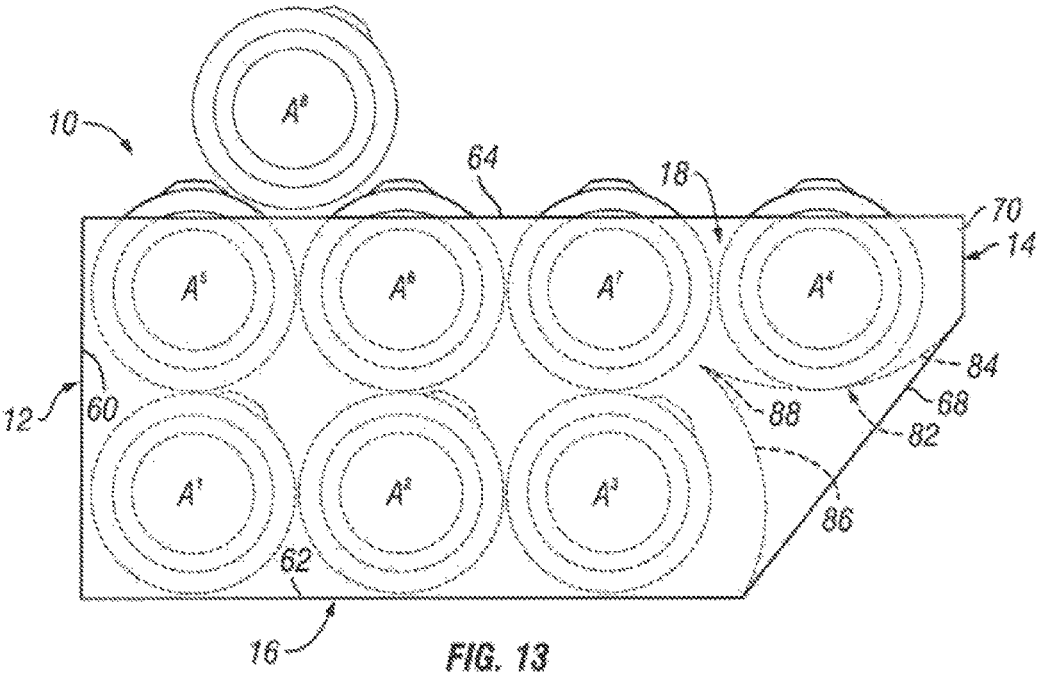
FIG. 13 is a side view of another configuration of the tray as shown in FIG. 6.

As described, FIG. 12 is a side view an embodiment of a tray 10 filled with an even number of cylindrical objects having a false bottom in a lower position. This display tray 10 may be shipped to a retailer in the extended outward position. Subsequently, the retailer may remove one of the articles $A^5$-$A^5$ from the tray and manually move the panel 82 from a lower, corner position to an inner position. As seen in FIG. 13, this embodiment permits maximum volume of product to be shipped and also to be stored upon angled shelf 30. This configuration may further allow for more efficient use upon a rectangular non-angled shelf.

Figure 14:
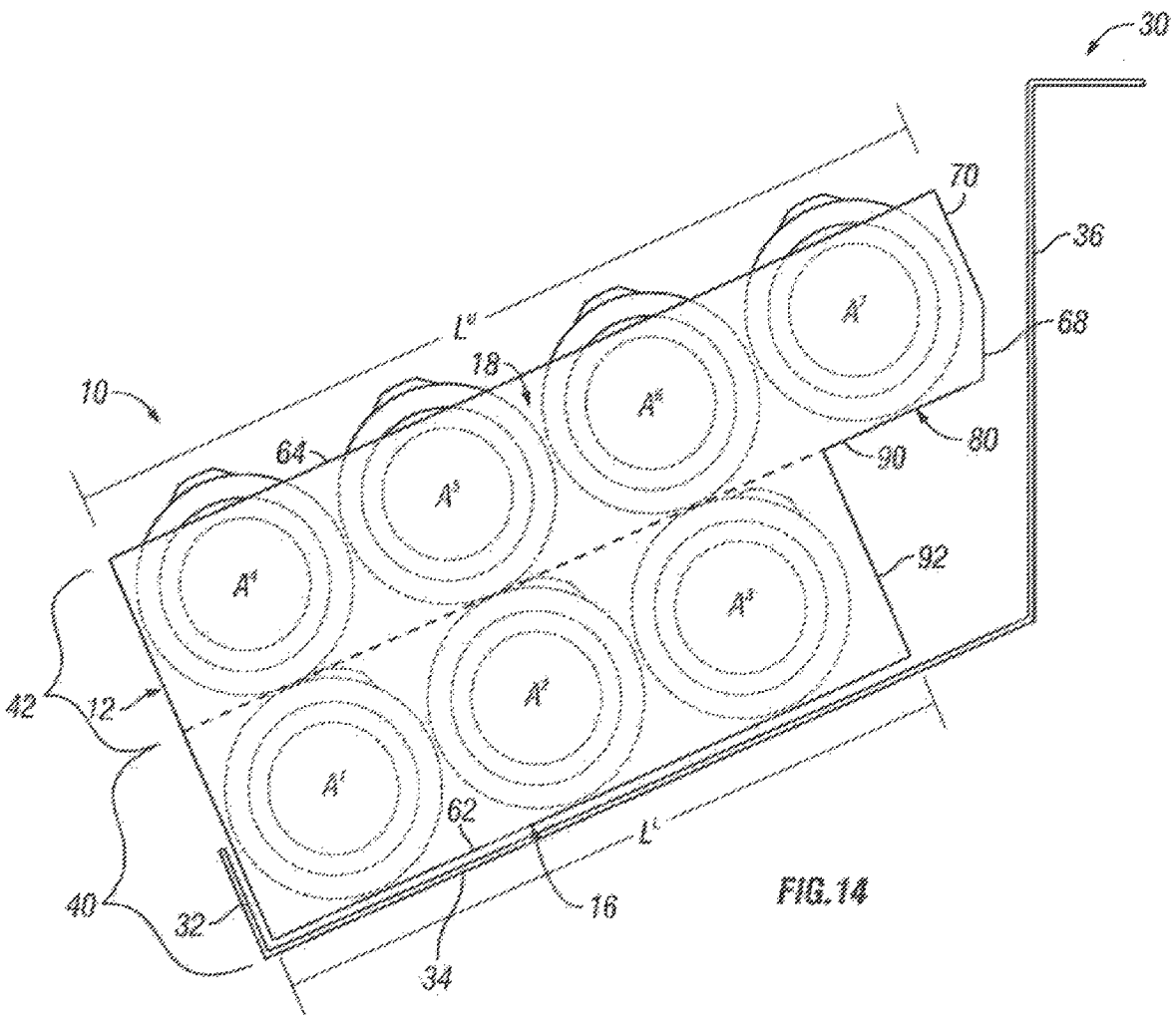
FIG. 14 is a side view of a tray in accordance with another embodiment of the invention.

FIG. 14 further illustrates an alternate embodiment of panel 80 in which it is more rigid. The panel may further include a top face 90 and side face 92. This tray 10 fits upon an angled shelf 30 and also supports the upper region 42 of articles $A^4$-$A^7$ from an area below.

While the invention has been described with respect to certain preferred embodiments, as will be appreciated by those skilled in the art, it is to be understood that the invention is capable of numerous changes, modification, and rearrangements, and such changes, modifications and rearrangements are intended to be covered by the following claims.

The invention is claimed as follows:

1. A display tray comprising:

(a) a front wall, a rear wall, a bottom wall and a plurality of side walls defining a receptacle, the receptacle having a lower region and an upper region, each region capable of containing a number of articles oriented in the horizontal direction;

(b) a raised panel adjacent the bottom and rear walls to reduce the capacity of the lower region, wherein the raised panel is a false bottom formed from a portion of the rear and bottom walls, the false bottom foldable along fold lines defined between the false bottom and the rear and bottom walls; and (c) wherein the upper region is capable of containing a greater number of articles than the lower region.

2. The display tray of claim 1 wherein the raised panel is capable of supporting at least one article in the upper region.

3. The display tray of claim 2 wherein the raised panel includes a top face capable of supporting an article in the upper region and a side face capable of containing articles in the lower region.

4. The display tray of claim 1 wherein the false bottom is moveable from a corner position in alignment with the rear and bottom walls to an inner position between the side walls.

5. The display tray of claim 4 wherein the false bottom when in the inner position includes a top arch and a lower arch.

6. A display tray comprising:

(a) a front wall, a rear wall, a bottom wall and a plurality of side walls defining a receptacle, the receptacle having a lower region and an upper region, each region capable of containing a number of cylindrical articles oriented in the horizontal direction;

(b) the upper region having a length greater than the lower region such that at least a portion of the upper region is positioned outwardly from a rear edge of the bottom wall; and (c) wherein the lower region is capable of containing a lesser number of articles than the upper region through a raised panel adjacent the bottom and rear walls, wherein the raised panel is a false bottom formed from a portion of the rear and bottom walls, the false bottom foldable along fold lines defined between the false bottom and the rear and bottom walls.

7. The display panel of claim 6 wherein the raised panel includes a top face capable of supporting an article in the upper region and a side face capable of containing articles in the lower region.

8. The display tray of claim 6 wherein the false bottom is moveable from a corner position in alignment with the rear and bottom walls to an inner position.

* * * * *